US011639288B2

(12) United States Patent
Clüsserath et al.

(10) Patent No.: US 11,639,288 B2
(45) Date of Patent: May 2, 2023

(54) APPARATUS AND METHOD FOR FILLING CONTAINERS WITH LIQUID CONTENTS

(71) Applicant: KHS GmbH, Dortmund (DE)

(72) Inventors: Ludwig Clüsserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/270,633

(22) PCT Filed: Aug. 28, 2019

(86) PCT No.: PCT/EP2019/072929
§ 371 (c)(1),
(2) Date: Feb. 24, 2021

(87) PCT Pub. No.: WO2020/052976
PCT Pub. Date: Mar. 19, 2020

(65) Prior Publication Data

US 2021/0387841 A1 Dec. 16, 2021

(30) Foreign Application Priority Data

Sep. 11, 2018 (DE) ..... 102018122062.6

(51) Int. Cl.
*B67C 3/28* (2006.01)
*B67C 3/20* (2006.01)

(52) U.S. Cl.
CPC ..... *B67C 3/286* (2013.01); *B67C 3/206* (2013.01)

(58) Field of Classification Search
CPC ..... B67C 3/286; B67C 3/20
(Continued)

(56) References Cited

U.S. PATENT DOCUMENTS 4,096,971 A * 6/1978 Kuckens ..... B67D 1/0036 222/145.5
5,584,324 A * 12/1996 Franke ..... B65B 37/06 141/1

(Continued)

FOREIGN PATENT DOCUMENTS

DE 4312367 A1 10/1994
DE 102006045987 A1 4/2008

(Continued)

OTHER PUBLICATIONS https://sciencing.com/flow-rate-vs-pipe-size-7270380.html (Hagen-Poiseuille's Law) (Year: 2017).*

(Continued)

*Primary Examiner* — Timothy P. Kelly
*Assistant Examiner* — Christopher M Afful
(74) *Attorney, Agent, or Firm* — Occhiuti & Rohlicek LLP

(57) ABSTRACT

An apparatus for filling containers with a product includes a filling element, a supply line that supplies the product, a switching valve, a control valve, a vessel that is disposed between the switching valve and the control valve, and a volumeter that is disposed between the switching valve and the control valve. The vessel supplies a pre-metered quantity of the product for discharge via the switching valve to the filling element, the quantity having been pre-metered by the volumeter. The supply line provides the product to the vessel at a first flow rate. Discharge of the product through the switching valve and into the filling element occurs at a second flow rate that exceeds the first flow rate, the first and second flow rates being volumetric flow rates.

16 Claims, 4 Drawing Sheets

(58) Field of Classification Search
USPC ..... 141/1
See application file for complete search history.

(56) References Cited

U.S. PATENT DOCUMENTS

| | | | | |
|---|---|---|---|---|
| 5,588,472 | A * | 12/1996 | Johnson | F17C 5/06 141/3 |
| 5,865,225 | A | 2/1999 | Weiss | |
| 8,875,752 | B2 * | 11/2014 | Monzel | B67C 3/30 141/2 |
| 10,131,527 | B2 * | 11/2018 | Fickert | B67C 3/26 |
| 2011/0303322 | A1 * | 12/2011 | Clusserath | B67C 3/286 141/8 |
| 2016/0052767 | A1 * | 2/2016 | Eaton | B67C 3/286 141/383 |
| 2018/0354769 | A1 * | 12/2018 | Cacciatore | B67C 3/286 |

FOREIGN PATENT DOCUMENTS

| | | | |
|---|---|---|---|
| DE | 102010019872 | A1 | 11/2011 |
| DE | 102014104873 | A1 | 10/2015 |
| WO | 2011044972 | A2 | 4/2011 |
| WO | 2011101012 | A1 | 8/2011 |

OTHER PUBLICATIONS

Merriam-Webster Dictionary (definition of the phrase "Slide Valve"): https://www.merriam-webster.com/dictionary/slide%20valve (Year: 2022).* https://hardhatengineer.com/gate-valve-types-parts/ (discloses gate valves as compatible with steam systems). (Year: 2022).*

* cited by examiner

APPARATUS AND METHOD FOR FILLING CONTAINERS WITH LIQUID CONTENTS

RELATED APPLICATIONS

This is the national stage of PCT application PCT/EP2019/072929, filed on Aug. 28, 2019, which claims the benefit of the Sep. 11, 2018 priority date of German application DE 102018122062.6, the contents of which are incorporated herein by reference.

FIELD OF INVENTION

The invention relates to an apparatus for filling containers with a liquid or filling product and to a method for filling containers.

BACKGROUND

Container handling machines in the beverage industry are expected to process upwards of 10,000 containers per hour. Some machines have capacities of more than 50,000 containers per hour. Of particular importance are filling machines.

A known method of filling, sometimes called "lightning filling," is to drive liquid under pressure into a container filled with steam with positive overpressure in the source of the product and negative pressure in the container. In this case, the steam condenses into water as a result of contact with the product. This makes determining the filling level imprecise.

Another known way to fill rapidly is a form-fill process. In such a process, one drives the product into a pre-form, thus bypassing the step of blow-molding the pre-form with gas. The volume of product that enters is measured by a flow meter. However, because of the high flow velocity, the measurement process is prone to inaccuracy.

SUMMARY

An object of the invention is to provide a device for filling containers with a liquid product that avoids the disadvantages of the prior art referred to heretofore, and with which the containers filled in particular by free-jet filling, lightning filling, or form-fill processes, the containers can be filled with the nominal or reference volumes required for them, and that therefore allows for reliable and precise measurement accuracy of the filled product in the containers.

According to a first aspect, the invention relates to a device for filling containers with liquid contents. Such a device includes at least one filling element for filling the container, a product feed-line for filling the container, at least one switching valve for switching the stream of contents to the at least one filling element, and at least one control valve, which is arranged upstream of the switching valve for controlling the stream of contents flowing through the switching valve. It is understood that the device according to the invention is a part of the system or, more precisely, is a part of a filling system.

The device according to the invention comprises at least one filling vessel arranged between the switching valve and the control valve and at least one volume-measuring device arranged between the switching valve and the control valve. In this situation the filling vessel provides a filling quantity of the product which has been pre-metered by means of the volume-measuring device per volume measurement for discharge to the filling element via the switching valve. In other words, the quantity filled into the container that is to be filled is already measured and provided separately or simply held in intermediate storage before the actual filling. This has the advantage that, while the container to be filled is being prepared, by evacuation, pre-stressing, closure, transfer for the filling, etc., an adequately long period of time is available for providing and measuring the filling contents. As a result, the pre-metered filling quantity from the filling vessel can be filled into the container with the nominal or reference volume conveyed to the container, and, in particular, advantageously at a very high speed.

In some embodiments, a first control circuit is assigned to the product-feed line. The first control circuit comprises a first pressure sensor for detecting the pressure in the product-feed line, at least one first regulating and control valve, and a first regulating and control unit.

To avoid confusion, it is noted that the term "circuit" is used in its older pre-electronic sense of indicating a loop or closed path. As such, the term "circuit" implies the existence of a closed control loop or feedback loop. However, the term "circuit" is not intended to be restricted to an electronic circuit in which the closed path is one traversed by charge.

In other embodiments, a distribution device, or distributor, is arranged downstream of the first regulating circuit. The distributor ultimately conveys the filling product to the at least one filling element. Accordingly, the filling speed, i.e. the flow speed, at which the filling product flows to the distribution device during the filling of the filling vessel, is regulated by making use of the first control circuit.

Preferably, the distribution device is configured as a filling product tank, which during the filling operation is partially filled with the liquid filling product, and specifically with the formation of a lower liquid space and an upper gas space, which is filled with a pre-stressing gas which is under filling pressure. The pre-stressing gas, which is preferably configured as CO2 gas, can be conveyed to the filling product tank by means, for example, of a feed line, not explained in any greater detail.

In other embodiments, the filling vessel is configured as a header vessel or a measuring and/or metering vessel, which, by means of the volume-measuring device, or volumeter, provides the pre-metered filling quantity per volume measurement to be discharged via the switching valve to the filling element.

Particularly advantageously, the volume-measuring device is arranged upstream of a header vessel and is configured as a flow-meter. As the flow-meter, use can be made for the invention of any flow measurement devices known from the prior art, such as, for example, volume flow-meters or mass flow-meters. Preferably, in this case a magnetic-inductive flow-meter (MIF) is configured as a volume measurement device, which undertakes the volume measurement for the pre-metering of the filling product for the at least one header vessel, i.e. determines the through-flow quantity of the filling product.

In other embodiments, assigned to the at least one header vessel is a second regulating circuit, which comprises at least one second pressure sensor for detecting the pressure in the at least one header vessel, at least one second regulating and control valve, and a second regulating and control unit.

For particular preference, a pressure regulating device, for the controlled and/or regulated conveying of a pre-stressing gas to the at least one header vessel, is assigned to the second regulating circuit. The second regulating circuit can therefore be configured, for example, as a pressure regulating circuit.

According to another advantageous embodiment variant of the device according to the invention, the device comprises a plurality of header vessels. In this situation, in each case, a corresponding number of regulating circuits are assigned to each header vessel, and, moreover, slide valves are provided between the switching valve and the control valve, by means of which the filling product flow into and out of the respective header vessels can be switched by means of the slide valves.

Particularly advantageously, the device according to the invention is configured as a filling machine of a circulating type, with a plurality of filling elements on a rotor which can be driven such as to rotate about a vertical machine axis, wherein the filling product for the filling elements is provided in the filling tank, likewise provided on the rotor and partially filled with the filling product, wherein, however, all other structural types of filling machines known from the prior art can likewise be used with the invention, without thereby departing from the concept of the invention.

According to another advantageous embodiment variant of the device according to the invention, the at least one measurement and/or metering vessel itself functions as a volume-measuring device. Particularly advantageously, for the filling of the at least one measurement and/or metering vessel, a piston-cylinder system is provided, which is driven by a controlled drive unit. In this situation, the drive unit is advantageously configured as a linear drive. With such measurement and/or metering vessels, the volume, i.e. the filling product quantity, is predetermined by the geometry of the piston-cylinder pair and the stroke travel of the piston in the cylinder. Accordingly, with such measurement and/or metering devices, the piston-cylinder pair serves both as a pump as well as a measuring device.

According to another advantageous embodiment variant of the device according to the invention, a cross-section of a product discharge line downstream of the at least one switching valve is greater than a cross-section of the product supply line, such that the filling product can thereby be discharged even more rapidly from the at least one filling vessel into the container.

According to another advantageous embodiment variant of the device according to the invention, the device is designed and configured in such a way that the supply of the filling product into the at least one filling vessel takes place at a first filling speed, measured as volume per time, and the discharge of the filling product from the at least one filling vessel, via the switching valve and filling element into the container, takes place at a second filling speed, measured as volume per time, wherein the second speed is greater than the first speed. Like the preceding embodiment variant, this embodiment variant also makes it possible, by imposing the second filling speed in relation to the first filling speed, to achieve a rapid discharge of the filling product from the at least one filling vessel into the container. The imposition of the speed is achieved, for example, by an imposition of pressure on the filling product in the product discharge line. Moreover, a combination of both embodiment variants is conceivable, namely a greater cross-section of the product discharge line as well as a second higher filling speed, such that a rapid filling, if not even a "lightning fast" filling of the container is possible.

According to a further aspect, the present invention also relates to a method for the filling of containers with a liquid filling product. In this situation, the filling product is conveyed via a product supply line to at least one switching valve, for switching the filling product stream to the at least one filling element, and at least one control valve, upstream of the switching valve, for controlling the filling product stream flowing through the switching valve, to at least one filling element for the filling of the container. The present invention is further characterized in that provision is made for a filling vessel arranged between the switching valve and the control valve, and for a volume-measuring device arranged between the switching valve and the control valve. By means of the at least one filling vessel, a pre-metered filling product quantity of the filling product is then supplied by means of the volume-measuring device, per volume measurement, for discharge via the switching valve to the filling element.

The core of the concept underlying the invention can essentially be seen in the fact that, by the pre-metering of the filling product quantity and by the providing of a pre-metered filling product quantity of the filling product in the at least one filling vessel, a reliable and precise measurement precision of the filling product filled into the containers can be achieved. Specifically, by this pre-metering by means of the at least one filling vessel, substantially more time is available for the measurement of the filling product, which is precisely what allows for these accuracies of measurement. The invention is therefore also particularly well-suited for devices and methods with which the filling product is filled rapidly into the containers, and in particular with which the filling product is accelerated during the filling to a maximum speed, as is the case with "lighting" filling or form-fill filling. Here too, by the pre-metering of the filling product quantity, the nominal or reference volume of the filling product conveyed to the containers can be precisely determined, and the filling at a substantially higher speed can be ensured.

The expression "essentially" or "approximately" in the meaning of the invention signifies deviations from the respective exact value by +/−10%, preferably by +/−5%, and/or deviations in the form of changes which are not of significance for the function.

Further embodiments, advantages, and possible applications of the invention are also derived from the following description of exemplary embodiments and from the Figures. In this situation, all the features described and/or represented in the Figures are in principle the object of the invention, individually or in any desired combination, regardless of their arrangement in the claims or reference to them. The contents of the claims are also made a constituent part of the description. As used herein, "regulating" refers to the use of a closed loop or feedback loop. A regulating system involves a measured variable, a manipulated variable, and a set point. In general, the regulating system attempts to minimize an error between the measured variable and the set point by varying the manipulated variable in a manner that depends on the observed error. Accordingly, the broadest reasonable interpretation of regulating and cognates thereof is not to be construed to cover any and all types of control that are possible.

Although some aspects have been described in connection with a device, it is understood that these aspects also represent a description of the corresponding method, such that a block element or a structural element of a device is also to be understood as a corresponding method step or as a feature of a method step. By analogy with this, aspects which have been described in connection with a method step or as a method step also represent a description of a corresponding block or detail or feature of a corresponding device. Some or all of the method steps can be carried out by a hardware apparatus (or with the use of a hardware apparatus), such as, for example, a microprocessor, a programmable computer, or an electronic circuit. With some exemplary embodiments, some or many of the most important method steps can be carried out by such an apparatus.

BRIEF DESCRIPTION OF THE DRAWINGS

The method is described hereinafter in greater detail on the basis of the Figures relating to exemplary embodiments. These show.

Figure 1:
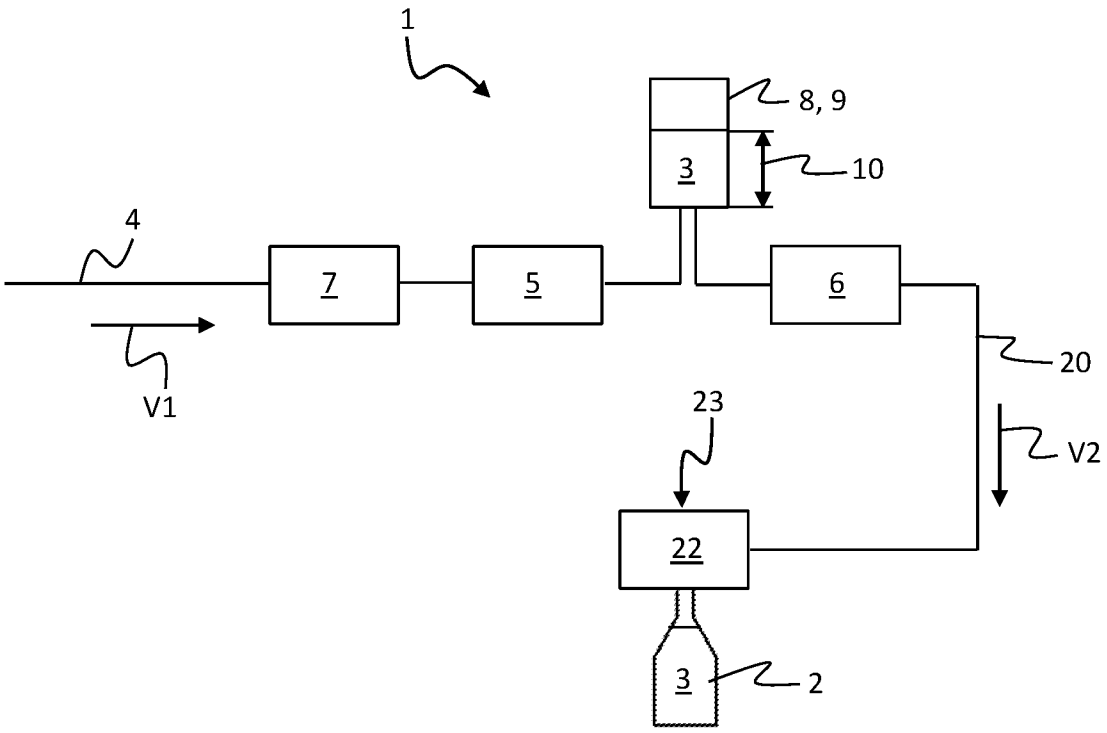
FIG. 1 shows an embodiment of a device for the filling of containers with a liquid filling product.

Identical reference numbers are used in the Figures for elements of the invention which are the same or have the same effect. Moreover, for the sake of easier overview, only those reference numbers are represented in the individual Figures which are required for the description of the respective Figure. The invention is also represented in the Figures only in schematic views to explain the mode of operation. In particular, the representations in the Figures serve only to explain the underlying principle of the invention.

DETAILED DESCRIPTION

FIGS. 1-4 shows a device 1 for carrying out free-jet filling of containers 2 with a liquid filling-product 3.

The device 1 comprises a filling-and-closing device 23 having a filling element 22 that fills the container 2 with liquid filling-product 3 that is fed from a product-feed line 4. The device 1 also includes a switching valve 6 and a control valve 7 upstream of the switching valve 6. The control valve 7 controls the stream of product 3 that flows towards the switching valve 22. The switching valve 22 switches the stream of product 3 towards the filling-and-closing device 23. Some embodiments include more than one filling element 22, switching valve 6, and control valve 7.

The device 1 also includes at least one filling vessel 8 and, in some embodiments, two filling vessels 8, 9. The filling vessels 8, 9 are arranged between the switching valve 6 and the control valve 7 along the path taken by the product 3. The device 1 also includes a volumeter 5 between the switching valve 6 and the control valve 7. Alternative embodiments include those with more than two filling vessels 8, 9 and those with more than one volumeter 5.

The volumeter 5 pre-meters a quantity 10 of product 3, which is held in the filling vessel 8, 9. This volume 10 is to be discharged, via the switching valve 6, to the filling element 22. This pre-metering is able to take place while the container 2 is being prepared for filling, for example by evacuation, pre-stressing, while the container 2 is being transferred, or while the previously-filled container 2 is being closed. This provides ample time for pre-metering. As a result of pre-metering, it becomes possible for a precise volume of liquid to be filled from the filling vessel 8, 9 or the filling vessels 8, 9. This is particularly useful for cases in which the container is to be filled rapidly. The invention is therefore also well-suited in particular for devices 1 and methods with which the filling product 3 must be filled rapidly for example, with lightning filling or form-fill filling.

To promote more rapid filling from the vessel 8, 9, it is useful for to have a discharge line 20 having a cross-section that is greater than that of the feed line 4. The discharge line 20 extends downstream of the switching valve 6.

In some embodiments, product 3 travels through the feed line 4 at a first volume rate-of-flow V1 and discharges into the filling element 22 at a second volume rate-of flow V2 that exceeds the first. In some cases, the second flow rate V2 is between about half a liter per second and two liters per second, or on the average at one liter per second or one and a half liters per second. The first flow rate V1 can be less than one liter per second or even less than half a liter per second. This permits volume to be measured more precisely.

Figure 2:
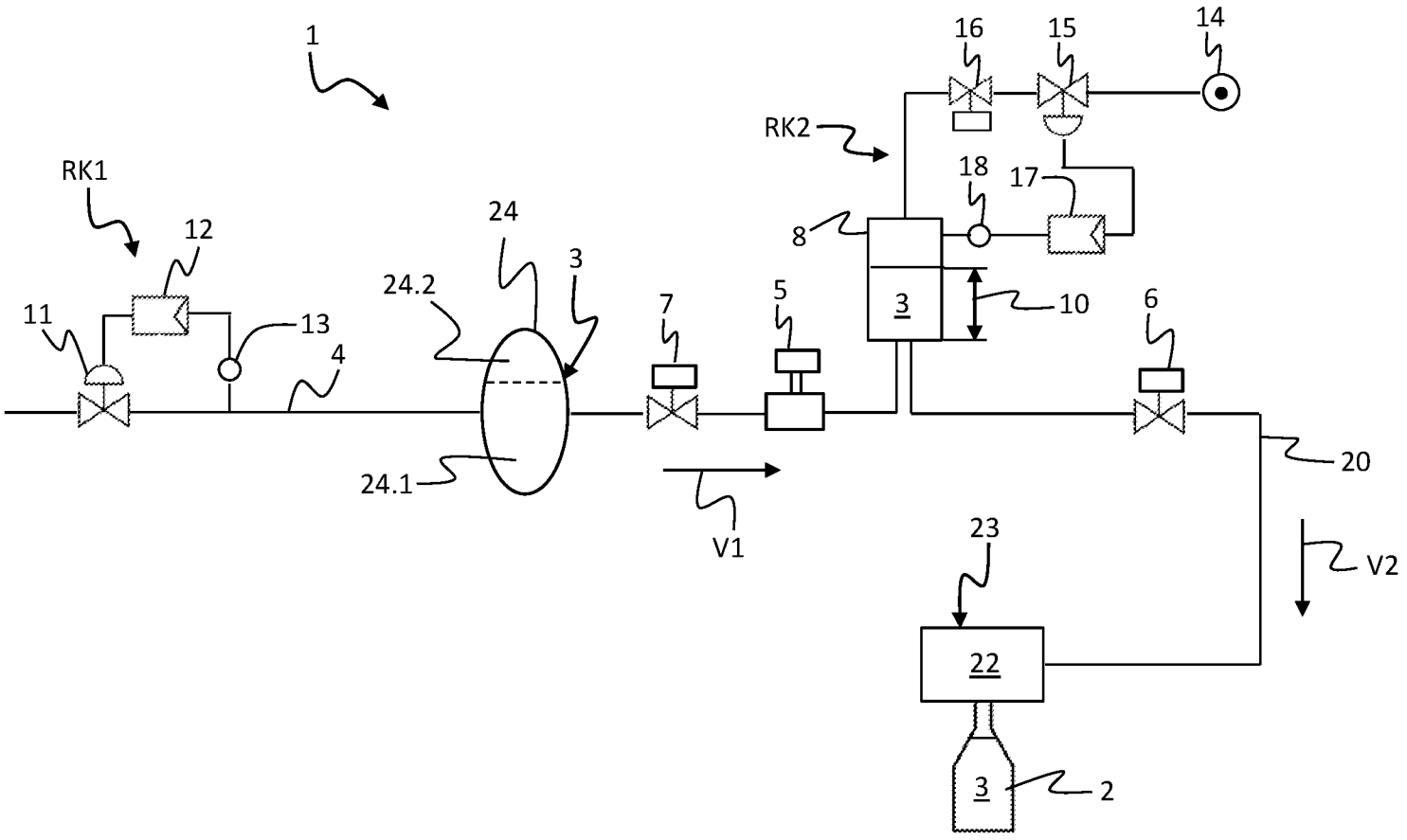
FIG. 2 shows another embodiment of a device for filling containers.

The embodiment shown in FIG. 2 includes a header vessel 8 that supplies the quantity 10 of product 3, which has been pre-metered by the volumeter 5. In the embodiment shown, the volumeter 5 is a flow meter 5, such as a magnetic-inductive flow meter.

The embodiment of FIG. 2 also includes a first regulator RK1 that includes a first pressure sensor 13, a first regulating valve 11, and a first controller 12. The first pressure sensor 13 detects pressure in the feed line 4 and provides it to the first controller 12, which thus carries out closed loop feedback control of the regulating valve 11.

The embodiment of FIG. 2 also includes a distributor 24 arranged downstream of the first regulator RK1. The distributor 24 conveys the filling product 3 towards the header vessel 8. The first regulator RK1 thus regulates the rate at which the product 3 flows to the distributor 24 during the filling of the header vessel 8.

Figure 3:
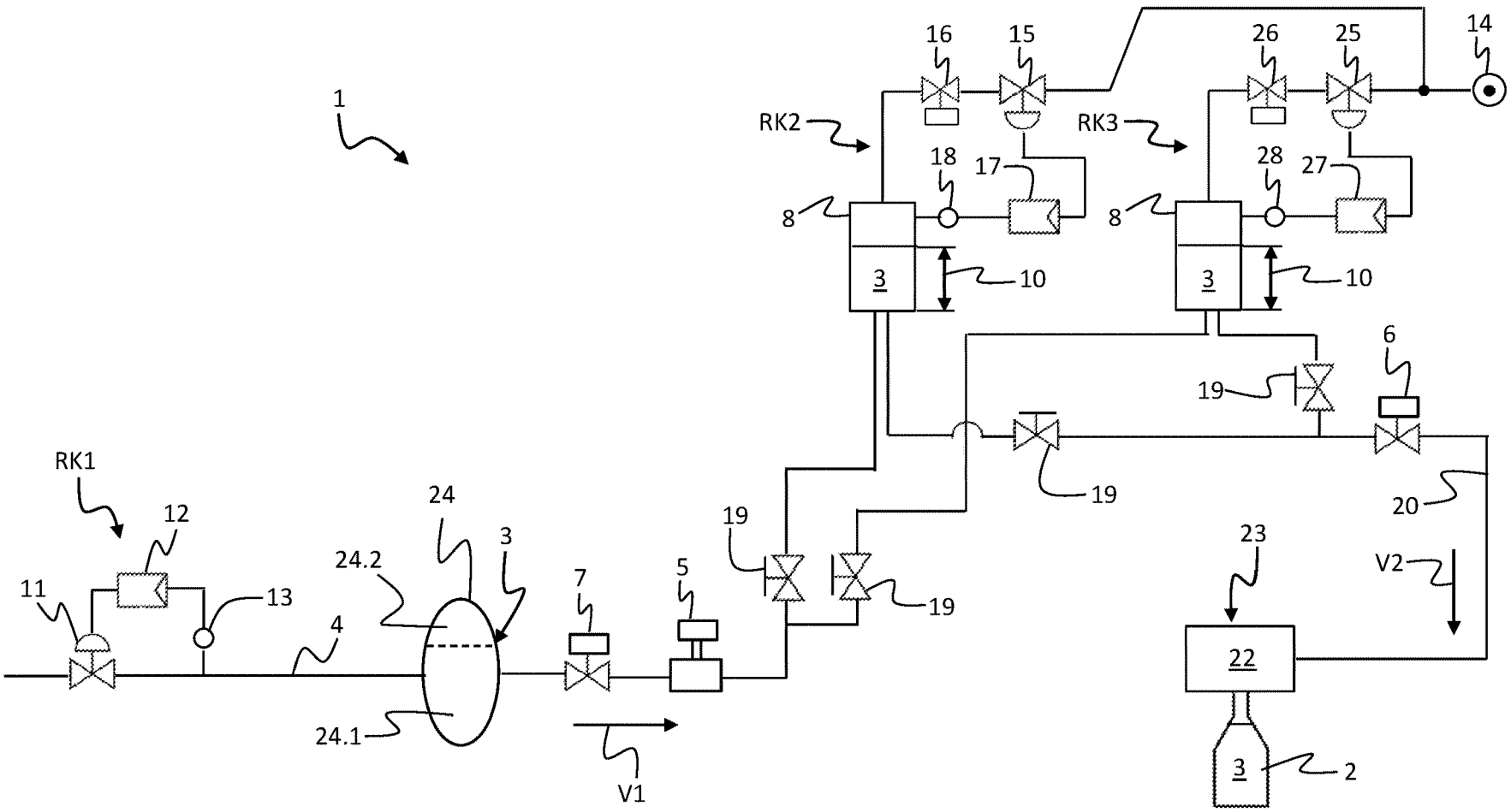
FIG. 3 shows yet another embodiment of a device for filling containers.

In FIG. 3, the distributor 24 comprises a tank 24. During filling, the tank 24 is partially filled with the liquid filling product 3. This results in a lower liquid space 24.1 and an upper gas space 24.2. A pre-stressing gas, which is maintained at a filling pressure, fills the upper gas space 24.2. The pre-stressing gas, which is preferably carbon dioxide, is conveyed to the tank 24 using a line that has been omitted for clarity.

The device 1 also includes a second regulator RK2. The second regulator RK2 includes a second pressure sensor 18, a second regulating valve 15, and a second controller 17. The second pressure sensor 18 detects pressure in the header vessel 8.

In a preferred embodiment, the second regulator RK2 includes a pressure regulating device 14 together with a second switching valve 16 for controlling or regulating the conveyance of a pre-stressing gas to the header vessel 8. The second regulator RK2 is therefore a pressure regulator.

The second regulator RK2 regulates the pressure in the container 2 so that it remains below the pressure of the gas space 24.2. This suppresses foaming due to any dissolved carbon dioxide in the product 3. The second regulator RK2 carries out such regulation during the pre-stressing phase, and at least before the beginning of the subsequent filling of the pre-metered filling product quantity 10 into the container 2.

FIG. 3 shows a further embodiment of the device 1 that differs as a result of having not one but two filling vessels in the form of header vessels 8. It is also conceivable, however, that other embodiments have more than two vessels 8.

The embodiment shown in FIG. 3 includes both the second regulator RK2 and a third regulator RK3 that together have regulating valves 15, 16, 25, 26, pressure sensors 18, 28, and controllers 17, 27. Each regulator RK2, RK3 is assigned to its own vessel 8.

The embodiment shown also includes corresponding slide valves 19 between the switching valve 6 and the control valve 7 for switching the product stream into and out of the respective header vessels 8.

The embodiment shown in FIG. 3 is particularly useful for lightning filling and for form-fill processes because of the demand for high speed. Such methods aspire to fill a half liter container in about three hundred milliseconds. With such speeds expected, it is possible that the flow meter 5 will not be able to measure volume with enough precision even with the use of a header vessel 8. However, having two header vessels 8 for each container 2 is to be filled enables the header vessels 8 to cooperate. As an example, while a container 2 is being filled with filling product 3 with a predefined filling product quantity 10 from one header vessel 8, the other header vessel 8 can be filled with the desired filling product quantity 10. Thus, the header vessels 8 alternate so that one can be filled while the other is being used for filling the container.

Figure 4:
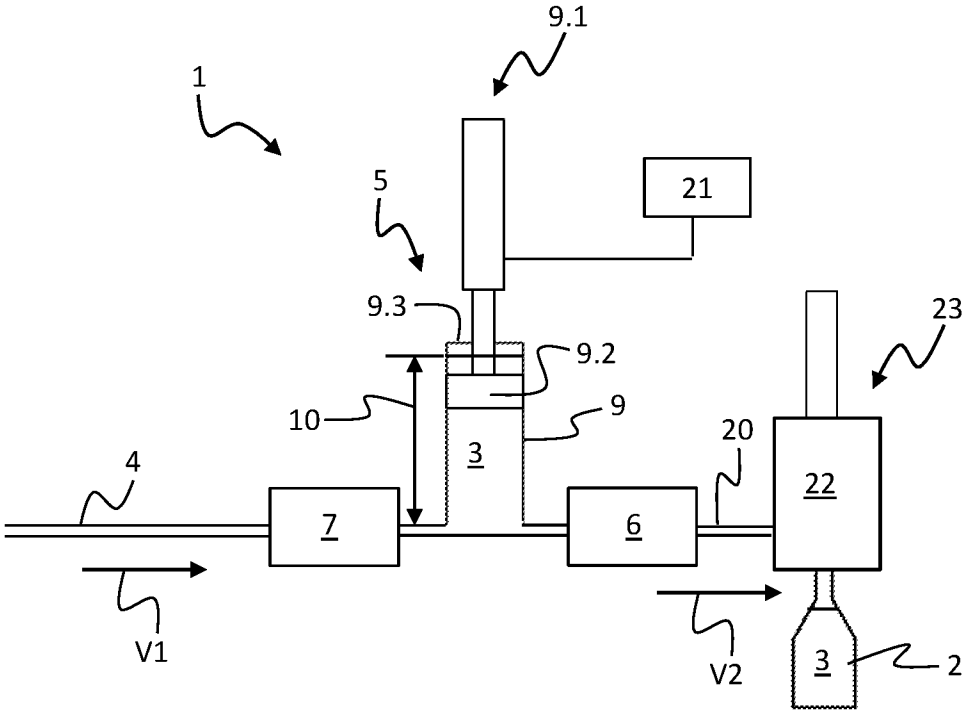
FIG. 4 shows another embodiment of a device for filling containers.

The embodiment shown in FIG. 4 has a filling vessel that is configured as a measuring and/or metering vessel 9 that supplies the filling product quantity 10 of the filling product 3, which has been pre-metered by the volumeter 5, per volume measurement, for discharging via the switching valve 6 to the filling element 22.

In this embodiment variant shown, the measuring and/or metering vessel 9 itself functions as a volumeter 5. In this embodiments, a drive 21 drives a piston 9.2 of piston-cylinder system 9.1 through a cylinder 9.3 to fill the vessel 9. Preferably, the drive is a linear drive 21 that controls the quantity 10 and the flow rate. In this embodiment, the geometry of the piston-cylinder system 9.1 and the piston's stroke controls the quantity 10.

The invention has been described heretofore by way of exemplary embodiments. It is understood that numerous modifications and derivations are possible, without thereby departing from the inventive concept underlying the invention.

The invention claimed is:

1. An apparatus for filling containers with a product, said product being a liquid filling-product, said apparatus comprising a filling element, a supply line that supplies said product, a switching valve, a control valve, a vessel, and a volumeter, wherein said volumeter is disposed between said control valve and said vessel, wherein said vessel is disposed between said switching valve and said volumeter, wherein said vessel supplies a pre-metered quantity of said product for discharge via said switching valve to said filling element while said container is being prepared for filling by at least one of evacuation and pre-stressing of said container, said quantity having been pre-metered by said volumeter, wherein said supply line provides said product to said vessel at a first flow rate, and wherein discharge of said product through said switching valve and into said filling element occurs at a second flowrate that exceeds said first flow rate, said first and second flow rates being volumetric flow rates, wherein said apparatus further comprises a discharge line that leads to said filling element, wherein at least one of said discharge line has a cross-sectional area that is greater than that of said supply line and said apparatus further comprises means for imposing pressure on said product in said discharge line.

2. The apparatus of claim 1, further comprising a first regulator, said first regulator comprising a pressure sensor that detects pressure in said supply line, a controller that receives said pressure, and a regulating valve that is controlled by said controller.

3. The apparatus of claim 2, further comprising a distributor that conveys said product towards said filling element, said distributor being arranged downstream of said first regulator.

4. The apparatus of claim 3, wherein said distributor comprises a tank, wherein, during filling, said tank is partially filled with said product and an upper gas space above said product is filled with a pre-stressing gas that is under pressure.

5. The apparatus of claim 1, wherein said vessel is a header vessel that supplies said pre-metered quantity of product for discharge via said switching valve to said filling element, said quantity having been pre-metered by said volumeter before reaching said vessel.

6. The apparatus of claim 5, wherein said volumeter comprises a flow meter that is arranged upstream of said header vessel.

7. The apparatus of claim 2, wherein said vessel is a header vessel, wherein said apparatus further comprises a second regulator that comprises a regulating valve, a pressure sensor, and a controller, wherein said pressure sensor provides a measurement of pressure in said header vessel to said controller for use by said controller in controlling said regulating valve.

8. The apparatus of claim 7, wherein said second regulator comprises a pressure regulator for regulating supply of a pre-stressing gas to said header vessel.

9. The apparatus of claim 5, wherein said header vessel is a first header vessel, said apparatus comprising a second header vessel having an associated regulator, wherein said apparatus further comprises slide valves, each of which is disposed between said switching valve and said control valve, wherein two of said slide valves are configured to cause product to enter said first header vessel and to be discharged from said first header vessel and two more of said slide valves are configured to cause product to enter said second header vessel and to be discharged from said second header vessel.

10. The apparatus of claim 1, wherein said volumeter comprises a piston, a cylinder, and a drive that drives said piston through said cylinder to cause filling of said vessel.

11. The apparatus of claim 10, wherein said drive comprises a linear drive.

12. A method for filling containers with a product, said product being a liquid filling-product, said method comprising providing said product at a first flow rate, using a volumeter that is disposed between a switching valve and a control valve to pre-meter a quantity of said product for discharge via said switching valve into a filling element, storing said quantity in a vessel that is disposed between said switching valve and said volumeter, and discharging said quantity from said vessel into said filling element at a second flow rate that exceeds said first flow rate, said first and second flow rates being volumetric flow rates, wherein said volumeter is disposed between said control valve and said vessel, said method further comprising selecting a cross-sectional area of said supply line and selecting a cross-sectional area of a discharge line through which said product is discharged such that said cross-sectional area of said discharge line is greater than that of said supply line or imposing pressure on said filling product in said discharge line to cause said second flow rate to exceed said first flow rate, wherein using said volumeter to pre-meter said quantity of said product comprises using said volumeter to pre-meter while said container is being prepared for filling by at least one of evacuation and pre-stressing of said container.

13. The method of claim 12, further comprising accelerating said product during discharge until further acceleration becomes impossible, whereby flow of said product reaches a maximum speed.

14. The apparatus of claim 1, wherein a relationship exists between said first and second flowrates, wherein said relationship is that for a given first flow rate, said second flow rate will exceed said first flow rate.

15. The apparatus of claim 1, wherein, for a given first flow rate, the second flow rate is neither less than nor equal to said give first flow rate.

16. The apparatus of claim 1, wherein said control valve controls a stream of said liquid product that flows towards said switching valve.

* * * * *